United States Patent [19]

Scott

[11] 4,422,578

[45] Dec. 27, 1983

[54] ROTARY GRAIN MILL HAVING MEANS FOR CONTROLLING AIR AND GRAIN FLOW THERETHROUGH, AND METHOD

[75] Inventor: Leon R. Scott, Sandy, Utah

[73] Assignee: Stratford Squire International, Salt Lake City, Utah

[21] Appl. No.: 299,499

[22] Filed: Sep. 4, 1981

[51] Int. Cl.[3] ..... B02C 7/11

[52] U.S. Cl. ..... 241/6; 241/15; 241/59; 241/245; 241/261.1

[58] Field of Search ..... 241/6, 15, 59, 100, 241/188 A, 245, 248, 260, 261.1

[56] References Cited

U.S. PATENT DOCUMENTS

| | | | |
|---|---|---|---|
| 6,902 | 11/1849 | Learned et al. . | |
| 213,471 | 3/1879 | Toufflin . | |
| 335,827 | 2/1886 | Mead . | |
| 543,633 | 7/1895 | Schoff . | |
| 901,217 | 10/1908 | Touya, Jr. . | |
| 1,447,013 | 2/1923 | Graaf . | |
| 1,970,330 | 8/1934 | Mason . | |
| 2,347,383 | 4/1944 | Wiegratz . | |
| 3,497,144 | 2/1970 | Hint . | |
| 3,815,835 | 6/1974 | Apostol et al. | 241/188 A |
| 3,847,363 | 11/1974 | Reinhall | 241/245 |
| 3,995,784 | 12/1976 | Izquierdo | 241/275 |
| 4,004,741 | 1/1977 | Perry | 241/55 |
| 4,011,027 | 3/1977 | Selder | 241/188 A X |
| 4,177,956 | 12/1979 | Fawcette | 241/188 A |
| 4,203,555 | 5/1980 | Dickson, Jr. | 241/15 |

FOREIGN PATENT DOCUMENTS

| | | | |
|---|---|---|---|
| 776725 | 2/1935 | France | 241/188 A |

*Primary Examiner*—Carl E. Hall

*Attorney, Agent, or Firm*—Robert R. Mallinckrodt; Philip A. Mallinckrodt

[57] ABSTRACT

Much better control of the grind of a rotary mill and much more uniformity of grind of the mill is achieved by better control of air flow through the mill, provided by making the milled product collecting pan of the mill air-tight and regulating the amount of in allowed to escape from the pan. The apparatus of the invention includes a housing in which are mounted two discs in spaced, confronting axial alignment, each disc having extending therefrom toward the other disc concentric rows of teeth. The rows of teeth overlap so that alternating rows of radially spaced, interposed teeth are formed. One of the discs is adapted to be rotated in relation to the other disc and grain to be milled, along with any air flow through the mill, is introduced through an inlet to the area between the discs inwardly of the innermost rows of teeth. An outlet into a substantially air tight collecting pan is provided for the milled material after it passes radially outwardly through the interposed row of teeth. An air control valve in communication with the collecting pan controls air flow out of the collecting pan which, in turn, controls air flow through the mill. Making the innermost row of teeth on the stationary disc, and making them shorter than the other teeth, substantially prevents the throwing of pieces of grain back out through the inlet under low feed condition.

8 Claims, 8 Drawing Figures

ROTARY GRAIN MILL HAVING MEANS FOR CONTROLLING AIR AND GRAIN FLOW THERETHROUGH, AND METHOD

BACKGROUND OF THE INVENTION

1. Field:

The invention is in the field of rotary mills for milling grains into flour or similar products.

2. State of the Art:

Numerous mills have been designed for milling grains, such as wheat, into flour. One of the more commercially successful of these mills is described in U.S. Pat. No. 4,203,555. In that mill, rows of teeth on a rotor are interposed between rows of stationary teeth on a stator. The grain is milled by its impact with the teeth as it moves radially outwardly through the alternating rows of stationary and moving teeth. The innermost row of teeth are on the rotor and the control of the grind is achieved by controlling the amount of grain and air flow into the grain inlet of the mill through the use of an air bypass valve. With the bypass valve closed, all air and grain flows through the grain inlet. Maximum throughput and coarse grind result. Motor loading is maximum and motor speed minimum. As the air bypass is opened, there is more air flow with less grain throughput. Motor speed increases and a finer grind results.

The mills of the prior art, including that of U.S. Pat. No. 4,203,555, have problems obtaining a uniform grind and controlling the grind. There is also a problem with some of the prior art mills of having pieces of grain thrown out of the feed entrance of the mill when only a small amount of grain is left to be fed into the mill.

SUMMARY OF THE INVENTION

According to the invention, much better control of the grind of a rotary mill and much more uniformity of grind of the mill is achieved by better control of air flow through the mill, provided by making the receiving bin of the mill air-tight and regulating the amount of air allowed to escape from the bin.

The rotary mill of the invention comprises a housing in which are mounted two discs in spaced, confronting axial alignment, each disc having extended therefrom toward the other disc concentric rows of teeth. The rows on each disc overlap the rows on the other disc so that alternating rows of radially spaced, interposed teeth are formed. Means, such as an electric motor, is provided to rotate one of the discs relative to the other which may be stationary. An inlet for grain and air opens into the space between the two discs inwardly of the innermost row of teeth and an outlet is provided for the grain and air after passing radially through the rows of teeth. The outlet opens into a substantially air tight collecting bin which has an air control valve in communication therewith to control the escape of air therefrom, thus controling the amount of air flow through the inlet, the space between the discs, and the collection bin.

It is preferred that the teeth on the discs be such that the innermost row of teeth be located on the stationary disc and be shorter in length than the remaining teeth. This construction has been found to greatly reduce or eliminate the throwing of pieces of grain back out of the inlet to the mill under low feed conditions.

THE DRAWINGS

In the accompanying drawings, which represent the best mode presently contemplated for carrying out the invention:

FIG. 1 ia a perspective view of the mill ready for operation;

FIG. 2, a vertical section taken along the line 2—2 of FIG. 1, and showing parts of the motor and motor cover in elevation;

FIG. 3, a vertical section taken along the lines 3—3 of FIGS. 1 and 2;

FIG. 4, a horizontal section taken along the line 4—4 of FIG. 2;

FIG. 5, a fragmentary vertical section taken along the line 5—5 of FIG. 1, and showing the air control valve;

FIG. 6, an exploded pictorial view of the valve shown in FIG. 5;

FIG. 7, a fragmentary working face view of the stationary disc showing the teeth arrangement; and FIG. 8, a fragmentary working face view of the rotating disc showing the teeth arrangement.

DETAILED DESCRIPTION OF THE ILLUSTRATED EMBODIMENT

Figure 1:
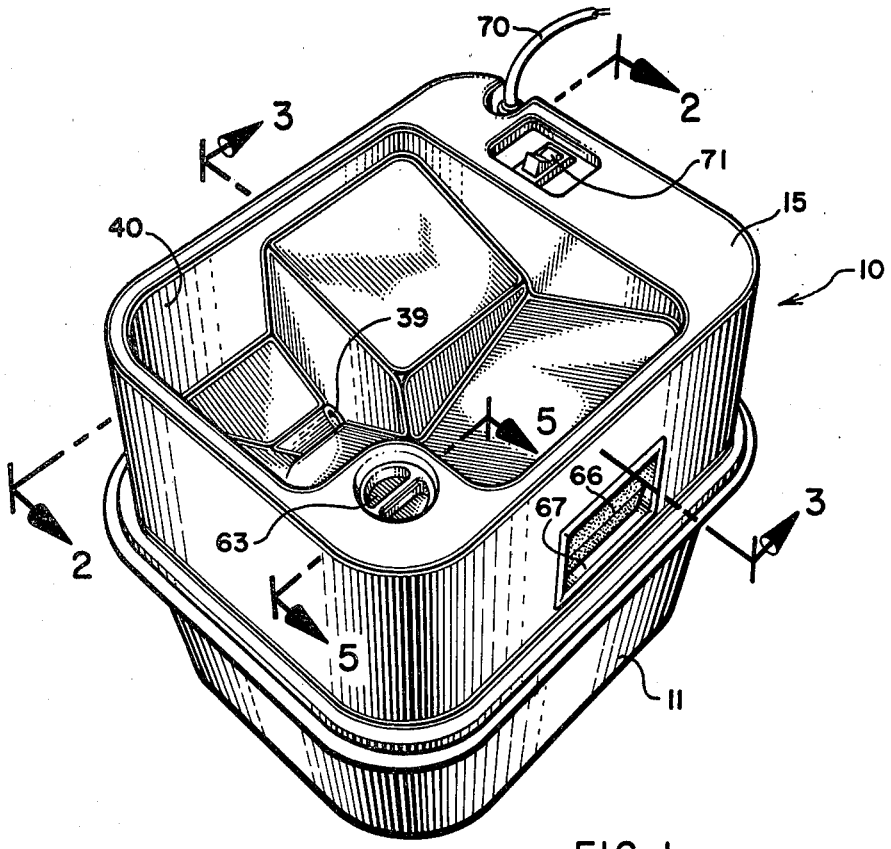

The mill as illustrated has two main body components, a housing 10 which houses all of the operating parts of the mill and a collecting pan 11 for collecting the flour or other milled product from the mill. The housing 10 and collecting pan 11 are normally held together in substantially air-tight relationship by spring-loaded locking pins 12, FIGS. 3 and 4, which fit through receiving holes 13 in the collecting pan.

Housing 10 has a base 14 configured to fit snugly within collecting pan 11, about the edge of which housing cover 15 is secured. A plastic sealing strip 16 extends around the lower portion of base 14 to insure a substantially air-tight seal between the collecting pan 11 and housing 10.

Figure 2:
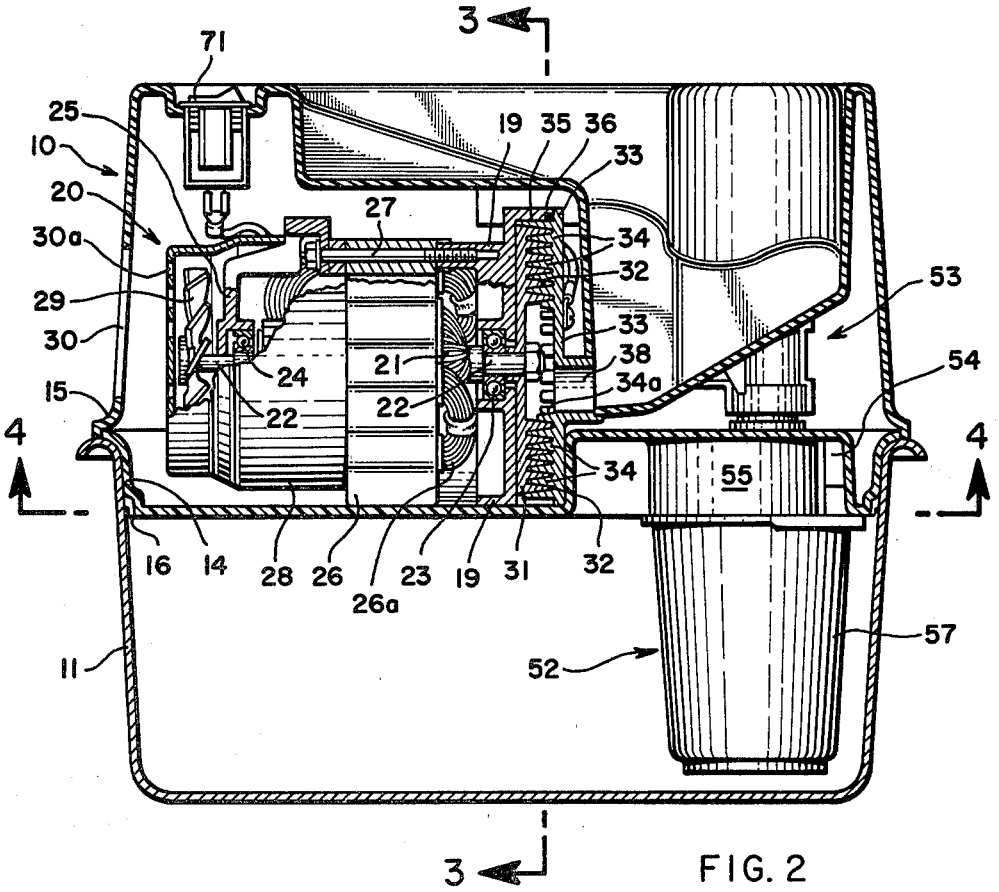
Figure 3:
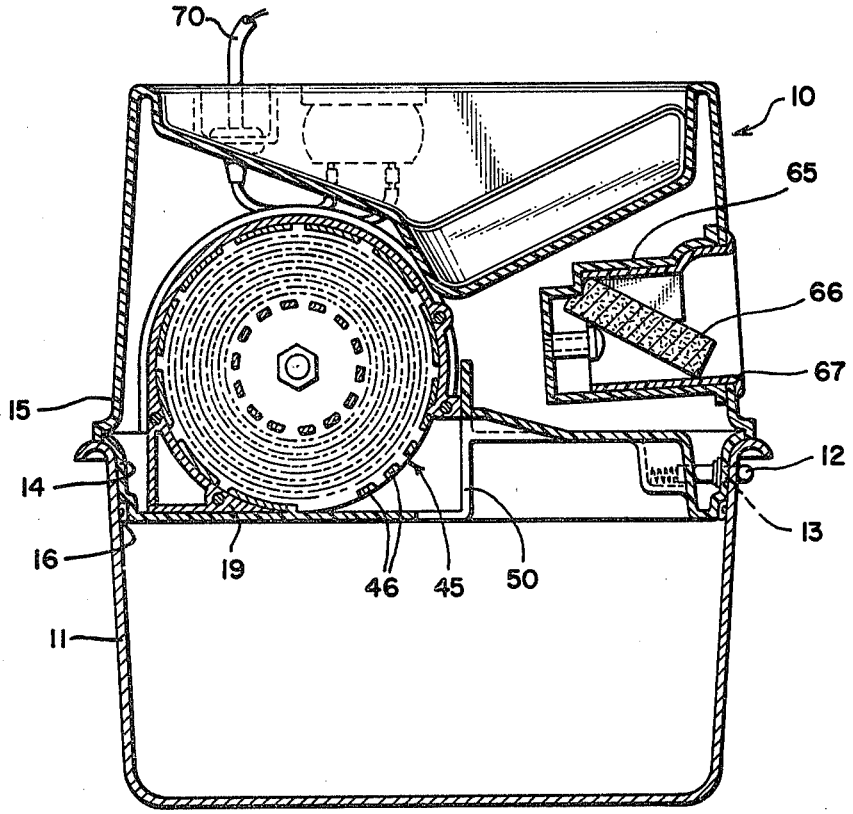
Figure 4:
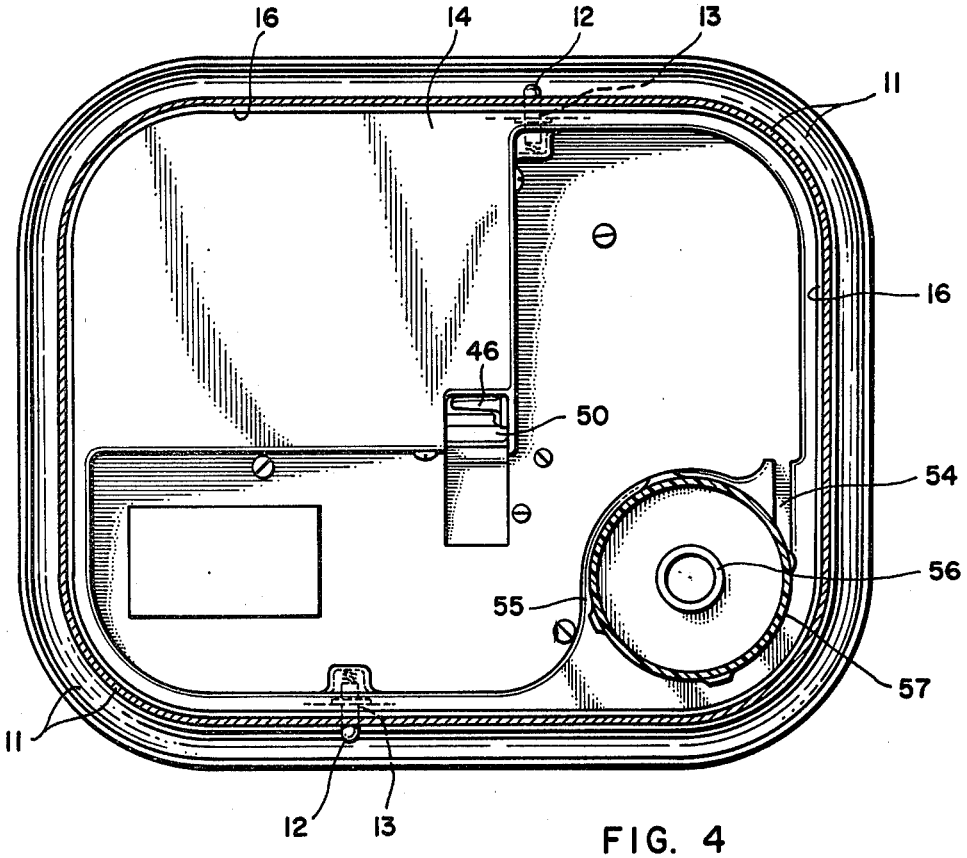

A motor and disc mounting frame 19, FIGS. 2 and 3, is secured to base 14 and has an electric motor 20 mounted thereon. The motor may conveniently be built from a motor kit, such as that supplied by Ametck-/Lamb of Kent, Ohio, under part no. 851958-1. The motor includes an armature 21 on a shaft 22, which is journaled in a bearing 23 mounted on frame 19 and in a bearing 24 mounted in a motor end support 25. Motor end support 25 along with the field support 26 are secured to mounting frame 19 by screws 27. Field windings **26*a* are held in place by field support 26. A motor cover 28 fits over the end of the motor and is held in place by motor end support 25. The brushes for the motor, along with other known parts not individually shown, are included within motor cover 28. A fan 29 is mounted on shaft 22 to draw air through hole 30 in housing cover 15 and through holes 30*a* in motor cover 28 and to force it through motor 20 to keep it cool. The air exhausts from motor cover 28 about the motor parts and through additional holes, not shown, in housing cover 15**.

A disc 31 is mounted on motor shaft 22 adjacent mounting frame 19. Disc 31 has radially spaced, concentric rows of teeth 32 extending therefrom. A second disc 33 is mounted in spaced, confronting, axial alignment with the first disc 31 and has radially spaced, concentric rows of teeth 34 extending therefrom. The teeth on each disc extend toward the confronting disc and overlap to form alternating rows of radially spaced, interposed teeth, FIG. 2. The second disc 33 is mounted so that it is stationary. Stationary disc 33 abuts mounting frame 19 and has an outer flange 35, which extends outwardly from disc 33 farther than teeth 34 and fits into mounting frame 19 to form a seal and to space such disc with ralation to frame 19 and disc 31. An O-ring 36 is provided to insure a good seal. Disc 32 has an opening 38 therein which serves as an inlet to the area between the discs inwardly of the first row of teeth. Opening 38 mates with hole 39, FIG. 1, in the bottom of a hopper 40 formed in housing cover 15 and adapted to receive grain to be milled.

It is preferred that the innermost row of teeth 34*a* be on the stationary disc 33 and that the length of such teeth be less than the length of the teeth in the other rows. The length of the first row of teeth is preferably just less than one-half that of the other teeth, the length being such that the distance from the end of the teeth to the confronting disc be at least as large as the minimum dimension of the largest grain particles to be milled. All of the teeth 32, 34 and 34*a* are preferably of approximately the same size as measured circularly of the disc with some variance so that substantially the same spacing between each of the teeth is maintained circularly of the disc, see FIGS. 7 and 8. This is not critical and various combinations of tooth size and spacing may be used, such as, for example, larger tooth spacing on one or more of the innermost rows of teeth than in the outermost rows. It has been found that the tooth spacing circularly of the disc has no significant effect on the milling action and that the spacing between the innermost rows of teeth does not have to be as large as the grain particles to be milled.

For a household mill used to mill wheat or other grains, such as corn, soybeans etc., to flour or a similar milled product, it has been found that teeth having a circumferential length of about 0.20 inch with circumferential spacing of 0.135 inch at the base is satisfactory. The height of the teeth is 0.41 inches with the height of the innermost row of short teeth being 0.17 inch this leaves about 0.24 inches beyond the ends of the short teeth. The radial spacing between adjacent rows of teeth affects the milling action, with generally greater spacing producing coarser ground product. The axial clearance between the ends of the teeth and the confronting disc also affects the milling action, with greater axial clearance having been found in this machine to generally produce a more finely ground product. To provide a mill giving a satisfactory range of fine and coarse product, it is preferred that the radial clearance between rows be about 0.035 inch and the axial clearance between the teeth and confronting disc be about 0.01 inch.

Figure 7:
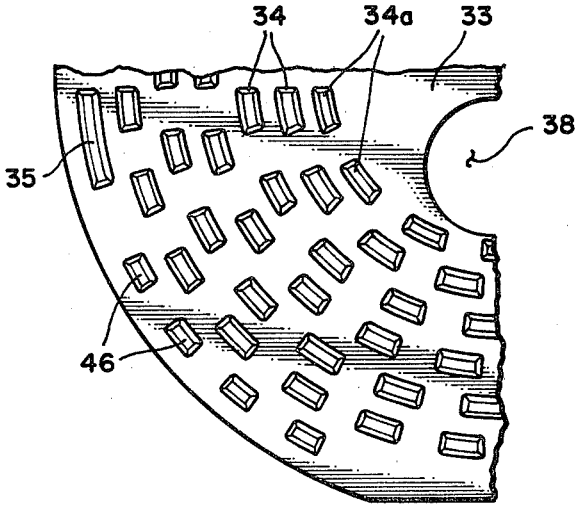
Figure 8:
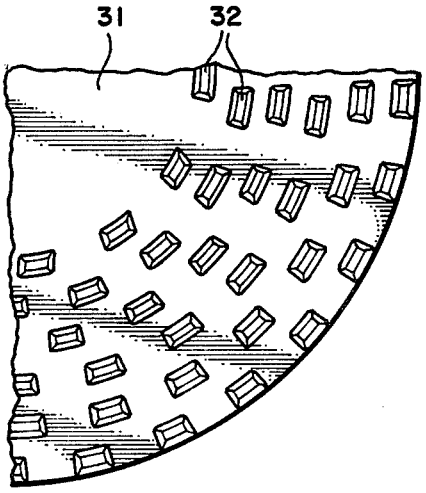

For ease of manufacture of disc 33 when it is of cast construction, flange 35 is discontinuous as shown in FIGS. 3 and 7 and fits snugly within mounting frame 19 so that it effectively forms, with frame 19, an outer circumferential wall, FIG. 3, with an opening at 45. Flange 35 could be solid rather than discontinuous, except at opening 45.

As shown in FIG. 3, frame 19 is mounted on base 14 so that opening 45 communicates directly through opening 50 in base 14 with collecting pan 11. This mounting is adapted to produce a substantially air tight seal so that air flow into or out of collecting pan 11 is limited to air flow through inlet 39. When disc 31 is rotating, such air flow will be through inlet 39 into collecting pan 11. A series of narrow teeth 46 are provided on disc 33 in opening 45 as a safety feature to prevent fingers that might be inserted through openings 50 and 45 from coming in contact with the rotating teeth of rotor 31.

Rotation of disc 31 is counterclockwise as viewed in FIG. 3, so that discharge of material through opening 45 is substantially tangential to discs 31 and 33 rather than radially therefrom. This causes the milled product to enter collecting pan 11 through opening 50 along base 14 at the top of collecting pan 11 rather than being directed downwardly into the pan.

Exhaust of air from the collecting pan is through a cyclone separator 52 and control valve 53. The top portion of the separator is molded as part of housing base 14 and includes air entrance 54, FIGS. 2 and 4, circular upper wall 55, and central air outlet 56, FIGS. 2, 4 and 5. A cyclone collector cup 57 is adapted to be removably secured to the molded wall 55. Air outlet 56 extends downwardly below the top of cup 57 when secured in place, so as to be below the bottom of air entrance 54 which is located at the top of cup 57.

Figure 5:
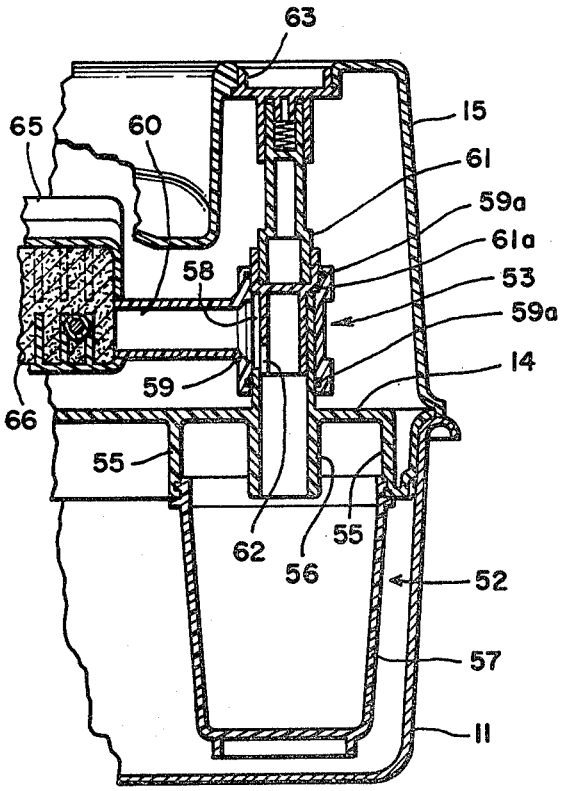

Air outlet 56 extends upwardly above base 14 and forms part of control valve 53. The upper portion of outlet 56 has a vertical opening 58 therein, FIGS. 5 and 6. A plastic tee 59 surrounds the upper portion of outlet 56, as shown in FIG. 5, with passageway 60 of tee 59 communicating with vertical opening 58. A valve member 61 is rotatably mounted in the top portion of outlet 56 and extends into the outlet at least as far as the bottom of opening 58. Valve member 61 may be conveniently mounted by means of a shoulder 61*a*, which rests on top of outlet 56. O-rings 59*a* act as a seal for tee 59 with respect to air outlet 56 and valve member 61.

Figure 6:
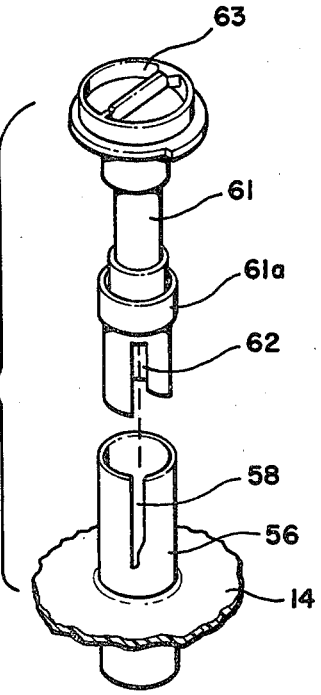

Valve member 61 also has a vertical opening 62 therein. When valve member 61 is inserted into outlet 56 and turned, opening 58 can be completely blocked or closed or opened to any extent, up to fully open when opening 62 is aligned with opening 58. It will be noted that opening 58 opens slowly from its fully closed position as the curved lower portion of opening 62 moves toward alignment with opening 58, and that the opening is progressively enlarged at a non-linear rate as the valve member is rotated counterclockwise as shown in FIG. 6. Although any type of air valve may be used so that air flow from the collecting pan 11 is controlled, the illustrated valve is presently preferred because of the vertical alignment of the outlet 56 and valve member 61 which causes any particulate matter in the air stream that might stick in the valve to tend to fall into cup 56 rather than collect in the valve. Also, turning of valve member 61 will tend to loosen any particulate matter that might get stuck in the valve or valve openings so that it can then fall into cup 57.

Valve member 61 extends upwardly to housing cover 15 and terminates as a knob 63, received by cover 15, so that valve member 61 may be easily turned by a user. Positions of the knob will be calibrated in terms of coarseness of grind from fine to coarse. The function of fineness to air flow has been found to be nonlinear, thus the nonlinear arrangement of valve 53 as described which enables the calibration of the valve knob positions to be equal steps.

The outlet 60 of tee 59 is connected to filter compartment 65 in which filter media 66, such as an open cellular foam plastic, is held in place by filter holder 67 which is received by filter compartment 65. After passing through filter media 66, the air is exhausted to the atmosphere.

An electrical cord 70 is provided for connecting the mill to a source of electrical power, and a switch 71 is provided for actuating the motor 20. The electrical connections are normal and well known to those skilled in the art, so are not shown.

To operate the mill, switch 71 is moved to "on" position actuating motor 20 which causes disc 31 to rotate. The motor preferably rotates at a no-load speed of approximately 25,000 to 30,000 RPM. Grain, such as wheat, to be milled is placed in hopper 40, where it enters the central area between discs 31 and 33 through opening 39 in the housing and 38 in disc 33. The grain is milled by the action of the interspersed rows of stationery and moving teeth as such grain and partially milled product, along with air, flow from the central area of the discs to the outside where the final milled product is ejected from the discs through opening 50 into collecting pan 11. The milled product settles out of the air stream into pan 11 as the air proceeds from opening 50 along base 14 in the upper part of pan 11 to cyclone separator entrance 54, FIG. 4, where additional particulate matter in the air stream is separated and falls to the bottom of cup 57. The air flows up outlet 56, through valve 53 to filter chamber 65, and through filter media 66 (which removes any remaining fine particulate material still in the air stream) to the atmosphere. It has been found that, because of the tangential outlet for the milled material, the milled product, such as flour, readily settles out of the air stream into the pan and that much less material is collected in the cyclone collector cup and the final filter than is the case when the milled product is ejected radially downwardly into the collecting pan where it continually stirs up the milled product. The advantage of this is that more grain may be milled before having to clean the cyclone collector cup and the filter element. Collecting pan 11 may be filled to capacity in one milling operation, without the cyclone collector cup filling past capacity and overloading the filter element, so as to restrict desired air flow.

The fineness of grind of the mill is controlled by controlling the air flow through the mill. This control is achieved by making the flow path from the point of entry into the mill substantially air-tight and by controlling the air which is allowed to escape from the collecting pan. Thus, only the amount of air which is allowed to escape from the collecting pan will be replaced by flow of air into the pan. Flow of air into the pan is limited to that flowing through the grain inlet 39. The amount of air flow through the inlet and milling discs controls the rate at which grain is drawn through the inlet and then into and through the discs. If the air flow is substantially blocked, the material being milled passes through the discs relatively slowly, being subjected to additiona tooth impact and being milled to a finer degree than when the product passes through more rapidly due to increased air flow. In addition, and most importantly, with less material passing through the discs, the speed of rotation of the disc is near the no-load speed, causing additional impact with the milled product as it passes through. As air flow is increased, more grain in drawn into the inlet and the milled product is drawn through the discs at a faster rate. The load on the discs increases and the rotation of disc 31 slows to as little as about 14,000 RPM from its no load speed of about 30,000 RPM.

With the present control system, the factors of air flow and motor speed affecting the grind are additive, i.e. as the air flow decreases, thus not pulling the material through as fast, the speed of the rotating disc increases and thereby results in a finer grind. As air flow increases, thus pulling the material through faster, the speed of the disc decreases, thereby decreasing the number of impacts on the grain and providing a coarse grind.

Mills using this additive control system have been found to provide much better control of grind than do mills which utilize the bypass type of control system. Such bypass control systems are actually subtractive. In other words, with the bypass control closed, there is minimum air flow through the system but maximum air flow through the grain inlet, resulting in the maximum amount of grain being drawn into the mill. This causes the motor to become loaded and speed of rotation decreased. This condition produces coarse grind. It should be noted that air flow conditions in the coarse grind setting is substantially similar for both types of machines. With the bypass system, for finer grind the total air flow is increased by opening the bypass. Thus, although the motor is not loaded as much, so that the speed of rotation is increased to provide additional impacts with the milled material to give a finer grind, the air flow is also increased, which pulls the milled material through the discs at a relatively faster rate. Also, more energy is needed to move the increased air flow through the mill.

It will thus be seen that greater control is possible with applicant's system of control. It has also been found that, because the amount of total air flow through the system is controlled positively, better uniformity of milled product is obtained from a full hopper of grain down to an empty hopper. With the bypass system, it has been found that, as the grain gets low in the hopper, the total air flow increases, thus giving a finer grind at the end of a batch then at the beginning. Also, because applicant's control system is additive, it has been found that the mill is not as sensitive to differences in the radial and axial clearances in the blades.

Having the innermost row of teeth located on the stator and shorter than the remaining teeth is the preferred arrangement, although not a necessary one, because it has been found to substantially eliminate the tendancy for the milling discs to eject grain particles back out through the inlet when only a small quantity of grain remains in the hopper to be milled. Use of such shorter teeth serves this purpose regardless of the air flow control system used with the mill.

Whereas the invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim

1. A rotary mill for milling particulate grain material, comprising a housing; a first disc having radially spaced concentric rows of teeth extending therefrom, said disc being mounted for rotation in said housing; a second disc having radially spaced concentric rows of teeth extending therefrom and mounted in the housing in spaced, confronting axial alignment with the first disc so that the rows of teeth on the first and second disc overlap forming alternating rows of radially spaced, interposed teeth; means for rotating the first disc relative to the second; inlet means for supplying grain and air to the area between the discs inwardly of the innermost row of teeth; outlet means for air and material that has passed radially through the interposed rows of teeth; means in substantially air-tight communication with the outlet means for collecting the milled grain material from the outlet; and air valve means in communication with the collecting means for controlling the amount of air flow from and through the collecting means, which, in turn, controls the air flow through the mill.

2. A rotary mill according to claim 1, wherein the innermost row of interposed teeth are shorter than the remaining rows of teeth.

3. A rotary mill according to claim 2, wherein the spacing between all teeth circularly of the disc is equal.

4. A rotary mill according to claim 3, wherein the second disc is stationary and the innermost row of interposed teeth is located on the second disc.

5. A rotary mill according to claim 2, wherein the second disc is stationary and the innermost row of interposed teeth is located on the second disc.

6. A rotary mill according to claim 1, wherein the outlet means directs the milled material and air tangentially to the discs and parallel to the bottom of the collecting means.

7. A rotary mill according to claim 1, wherein the air valve means includes a vertical air passage having an opening along one side thereof, and a valve insert rotatably received by the air passage and having an opening along one side thereof so that the valve means is closed by rotation of the valve insert in the air passage to a position where the respective openings are not aligned, and is opened to any degree by rotating the valve insert so as to partially or fully align the respective openings.

8. A method of controlling the air and grain flow into and through a rotary mill for milling particulate grain material, such mill having a pair of confronting, axially spaced discs, each having radially spaced, concentric rows of teeth extending therefrom toward the confronting disc and overlapping to form alternating rows of radially spaced, interposed rows of teeth, at least one disc being adapted to be rotated in relation to the other, an inlet for supplying grain and air to the area between the discs inwardly of the innermost row of teeth, outlet means for the discharge of milled material after passage radially through the interposed rows of teeth, and means for collecting the milled material from the outlet, comprising the steps of making the air path from the inlet through the collecting means substantially air-tight; providing a controlled outlet for all air after passage through the collecting means; and controlling the outlet to control the amount of air allowed to pass therethrough.

* * * * *